United States Patent [19]

Suzuki

[11] Patent Number: 4,600,295

[45] Date of Patent: Jul. 15, 1986

[54] IMAGE FORMING APPARATUS

[75] Inventor: Koji Suzuki, Yokohama, Japan

[73] Assignee: Canon Kabushiki Kaisha, Tokyo, Japan

[21] Appl. No.: 674,918

[22] Filed: Nov. 26, 1984

[30] Foreign Application Priority Data

Nov. 30, 1983 [JP] Japan ..... 58-224459
Nov. 30, 1983 [JP] Japan ..... 58-224460
Nov. 30, 1983 [JP] Japan ..... 58-224461

[51] Int. Cl.[4] ..... G03G 15/06

[52] U.S. Cl. ..... 355/14 D; 118/647; 355/3 DD

[58] Field of Search ..... 355/14 D, 3 DD, 10; 118/647-651, 653-658

[56] References Cited

U.S. PATENT DOCUMENTS 4,376,813 3/1983 Yuge et al. ..... 118/647 X
4,391,891 7/1983 Tamura et al. ..... 118/647 X
4,482,243 11/1984 Suzuki et al. ..... 355/14 D

*Primary Examiner*—R. L. Moses
*Attorney, Agent, or Firm*—Fitzpatrick, Cella, Harper & Scinto

[57] ABSTRACT

There is disclosed a copier employing a square wave developing bias voltage instead of the conventional sinusoidal AC developing bias. Such square wave developing bias reduces the moving energy of the toner and prevents the discharge between the developing sleeve and the photosensitive drum.

23 Claims, 16 Drawing Figures

IMAGE FORMING APPARATUS

BACKGROUND OF THE INVENTION

1. Field of the Invention

The present invention relates to an image forming apparatus such as a copier, laser beam printer or the like, and more particularly to such an image forming apparatus employing an electrophotographic process.

2. Description of the Prior Art

Various apparatus utilizing an electrophotographic process, such as copier or laser beam printer are already in wide use. Among such apparatus there is already known an apparatus in which image information is optically given to a photosensitive member composed for example of CdS to form an electrostatic image thereon, which is then subjected to a development step such as jumping development to obtain a visible toner image for transfer onto a recording sheet.

In the development step of the above-mentioned process there is already known a method of applying an AC developing bias voltage across the photosensitive member and the developing unit to maintain appropriate density and tonal rendition. A sinusoidal voltage is usually employed as said AC bias voltage. Also there is known a method of super-posing a DC voltage to said AC developing bias voltage to maintain an appropriate level of deposition of toner onto the photosensitive member, or to prevent the toner deposition in the preparatory steps.

In such conventional developing unit, the use of sinusoidal developing bias voltage of a single frequency provides the advantage of easy control of wave form with respect to the oversheet or distortion and the possibility of employing a transformer and amplifier of a narrow band width for handling said AC bias voltage, but is associated with the following drawbacks.

The sinusoidal AC bias voltage gives rise to a large moving energy of the toner because of the large difference between the average level and the peak level of the signal and tends to cause discharge between the photosensitive member and the developing sleeve positioned opposed thereto because of the same reason. These phenomena become enhanced when a DC voltage is superposed as explained above, because of the higher peak value.

SUMMARY OF THE INVENTION

In consideration of the foregoing, an object of the present invention is to provide an improved image forming apparatus.

Another object of the present invention is to provide an image forming apparatus capable of stable image development.

Still another object of the present invention is to provide an image forming apparatus with increased safety.

Still another object of the present invention is to provide an image forming apparatus employing a square-wave voltage as the developing bias voltage.

The foregoing and still other objects of the present invention will become fully apparent from the following description.

DETAILED DESCRIPTION OF THE PREFERRED EMBODIMENTS

Now the present invention will be clarified in detail by embodiments thereof shown in the attached drawings.

Figure 1:
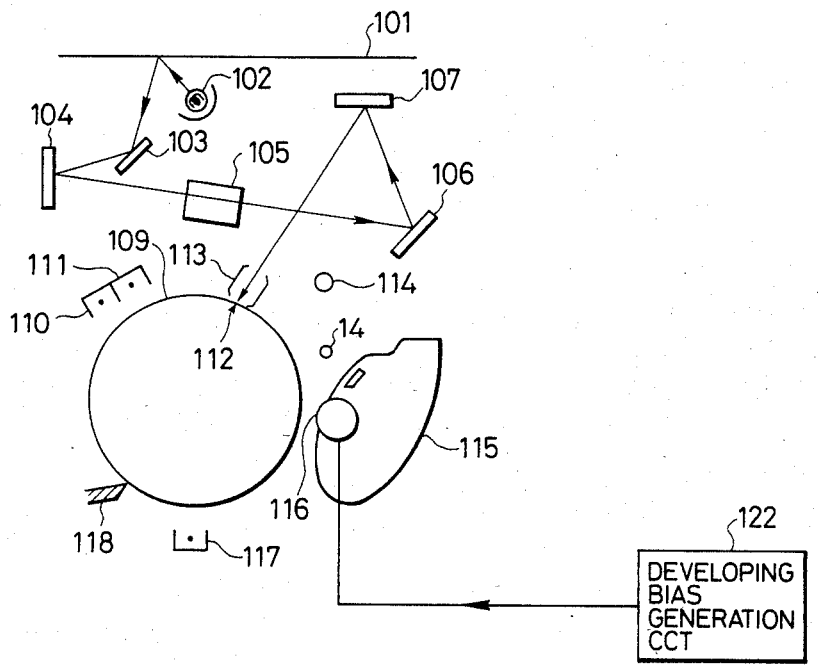
FIG. 1 is a schematic view of a copier in which the present invention is applicable.

FIG. 1 shows an image forming apparatus constructed as an electrophotographic copier, wherein, under a transparent original support table 101, there are provided an illuminating lamp 102, movable mirrors 103, 104, a fixed lens 105 and fixed mirrors 106, 107 constituting an optical system for scanning an unrepresented original document placed on said original support table 101, and the reflected light from said original is guided onto a recording member, which is a photosensitive drum 109 in the present embodiment.

The photosensitive drum 109 is provided with a photosensitive layer overcoated with a transparent insulating layer and is rotated clockwise, whereby a preliminary charge eliminator 110 receiving a high AC voltage from an unrepresented high-voltage power supply performs AC charge elimination to dissipate any charge on the drum surface. Then the photosensitive drum 109 is uniformly charged by a primary charger 111, and subsequently reaches an exposure station 112, where the drum surface receives the light reflected from the original and is subjected to AC charge elimination by an AC charge eliminator 113. In this manner an electrostatic latent image corresponding to the original is formed on the photosensitive drum 109, then is uniformly illuminated by a lamp 114 to enhance the tonal rendition, and is rendered visible by a developing roller 116 or a developing unit 115 receiving a determined bias voltage from a developing bias generating circuit 122. Then an unrepresented recording sheet supplied from a sheet feeding unit is brought into contact with the photosensitive drum 109, and the image on the drum is transferred onto said recording sheet by means of a transfer charger 117. Subsequently the recording sheet is discharged from the copier, and the photosensitive drum is cleaned with a cleaner 18 for repeated use in a succeeding cycle.

A potential sensor 14 for detecting the surface potential of the photosensitive drum 109 detects said potential prior to the copying cycle to control the amount of charge, amount of exposure and developing bias in response to the output of said sensor.

Figure 2:
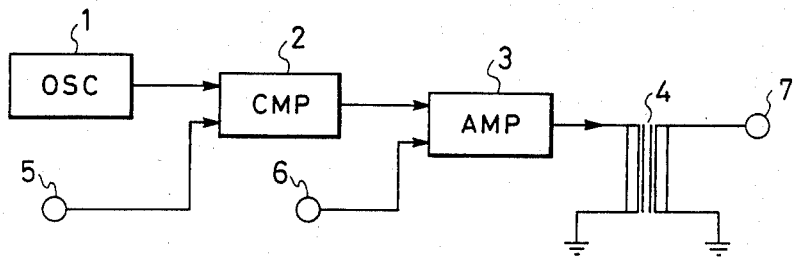
FIG. 2 is a block diagram showing an embodiment of a developing bias generating circuit shown in FIG. 1.

FIG. 2 shows an embodiment of the developing bias generating circuit 122 of the image forming apparatus shown in FIG. 1.

An oscillator 1 supplies the output signal thereof to a comparator 2 which has another input terminal 5 and of which output is connected to an amplifier 3. Said amplifier 3 is provided with another input terminal 6 and supplies the output signal to a voltage elevating transformer 4, of which output is connected to an output terminal 7 for supply to the developing unit 115.

Figure 3:
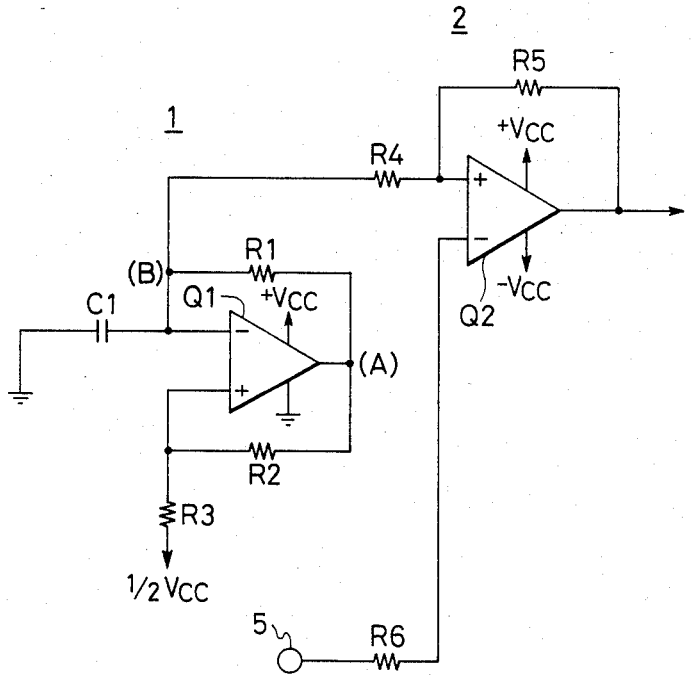
FIG. 3 is a detailed circuit diagram showing a part of the circuit shown in FIG. 2.
Figure 4A:
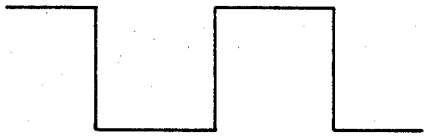
FIGS. 4A, 4B, 4C, 4D and 4E are wave form charts showing signals at various parts in the circuit shown in FIG. 3.
Figure 4B:
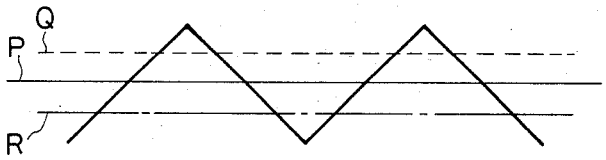
Figure 4C:
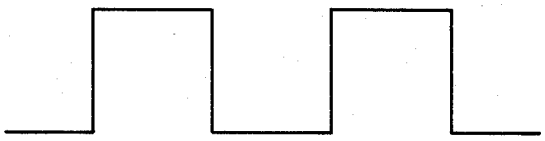
Figure 4D:
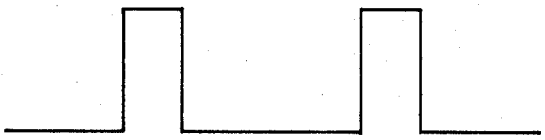
Figure 4E:
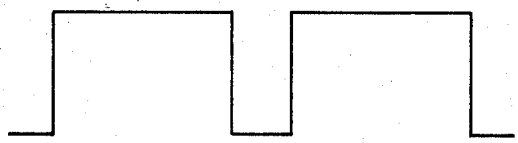

The sinusoidal voltage conventionally employed as the developing bias is replaced according to the present invention by a square wave voltage which is generated by the oscillator 1, which is constructed as more detailedly shown in FIG. 3.

FIG. 3 shows the details of the oscillator 1 and the comparator 2 shown in FIG. 2, which are composed of operational amplifiers Q1, Q2 of high gain and high impedance. The oscillator 1 is composed of a known blocking oscillator for generating a sawtooth wave through a positive feedback through resistors R1 and R2, with a frequency to be determined in relation to a ratio R1/R2 and a time constant C1·R1.

Also the comparator 2 is of a known structure for comparing a reference voltage supplied from the input terminal 5 through a resistor 6 with the output voltage of the oscillator 1 entered through a resistor R4.

FIGS. 4(A) to 4(E) show voltage wave forms in various points in FIG. 3.

In FIG. 4, a curve (A) represents the output of the operational amplifier Q1 shown in FIG. 2, while curve (B) represents a sawtooth wave generated at the negative input terminal of the operational amplifier Q1. In the following there will be briefly explained the oscillating function of the oscillator 1. The voltage of the negative input terminal of the operational amplifier Q1 tends to converge to the output voltage periodically with a time constant C1·R1 each time the output of the operational amplifier Q1 is switched. The positive input terminal receives the output voltage of the amplifier shown in the curve (A) after voltage division by resistors R2 and R3. The output changes from the high level to the low level or in the opposite direction when the voltage at the negative input terminal reaches the voltage at the positive input terminal, and the direction of converging of the voltage of the negative input terminal is also inverted. The output voltage is again inverted when the voltage at the negative input terminal reaches that at the positive input terminal after a determined period. In this manner the oscillator 1 repeats the oscillation at an interval determined by C1·R1, thus generating a sawtooth wave represented by the curve (B) in FIG. 4.

Then, in the comparator 2, said sawtooth wave is compared by the operational amplifier Q2 with a DC voltage entered from the input terminal 5, and the output is inverted each time said sawtooth wave crosses the DC voltage level. Thus comparisons with DC voltages of three different levels represented by P, Q and R in FIG. 4 (B) respectively provide square waves of different duty ratios represented by curves (C) to (E) in FIG. 4. A feedback resistor R5 provides the operational amplifier Q2 with a slight hysteresis to stabilize the output thereof.

The square wave thus generated with a duty ratio corresponding to the DC voltage from the input terminal 5 is supplied to an amplifier 3 for power amplification, and is then supplied to the primary side of the voltage elevating transformer 4, which has a voltage elevating ratio of about 100 to generate an output of 1000–2000 Vpp at the secondary side. The square wave of an elevated voltage with a determined duty ratio is supplied, through the terminal 7, to the developing roller 116 of the developing unit 115. The input terminal 6 of the amplifier 3 is a remote control terminal for shutting off the output for example in case of an emergency.

Figure 5:
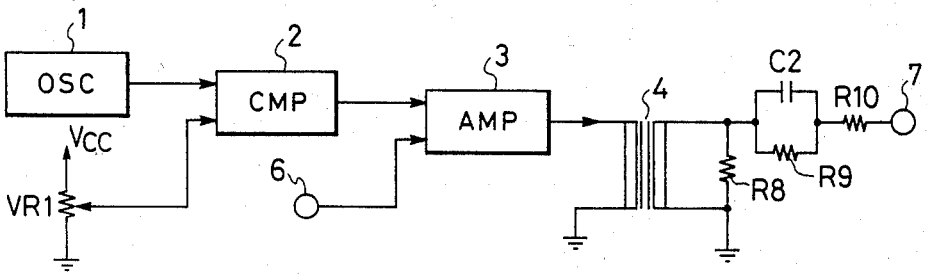
FIG. 5 is a block diagram showing another embodiment of the developing bias generating circuit of the present invention.

In this manner the square waves of different duty ratios can be utilized as the developing bias voltage. In the square wave, the average DC voltage at the secondary side of the voltage elevating transformer 4 is equal to zero at a duty ratio of 1:1, but it can be modulated from a negative value to a positive value by varying the duty ratio as described above. Consequently, for example in a copier, the image density can be regulated by supplying a determined voltage across a variable resistor VR1 as shown in FIG. 5 and supplying the divided voltage to the comparator 2 to vary the duty ratio of the generated square wave. In the circuit shown in FIG. 5, there are further provided a breeder resistor R8 connected across the voltage elevating resistor 4 for stabilizing the output, and protecting resistors R9, R10 connected to the output terminal for controlling the current when the output terminals are shortcircuited. The resistor R9, having a parallel condenser C2 for AC bypass, stops the DC current in case of shortcircuiting.

Figure 6:
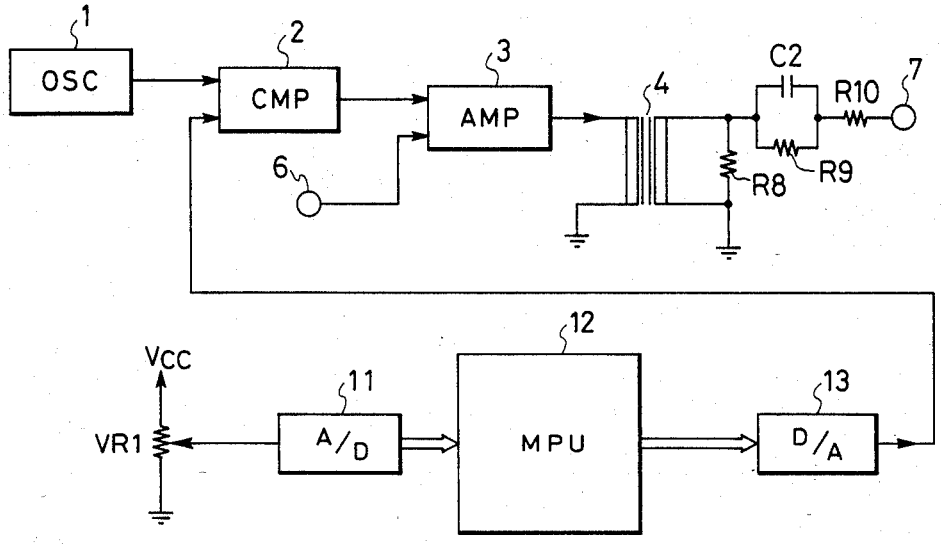
FIG. 6 is a block diagram showing still another embodiment of the developing bias generating circuit of the present invention.

Also in case of a copier or a laser beam printer in which the image forming conditions are controlled by a microcomputer, the voltage divided by the variable resistor VR1 is supplied to the microcomputer 12, as shown in FIG. 6, after conversion into a digital value by an A/D converter 11. The microcomputer 12 releases a digital value corresponding to a desired duty ratio, and said digital value is converted into an analog value by a D/A converter 13 and supplied to the comparator 2 for controlling the duty ratio.

Figure 7A:
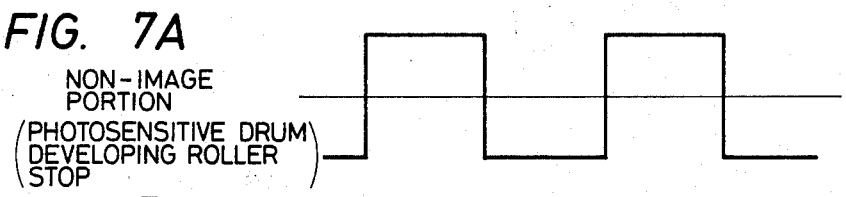
FIGS. 7A, 7B, 7C, are wave form charts for explaining the control process in the developing bias generating circuit shown in FIG. 6.
Figure 7B:
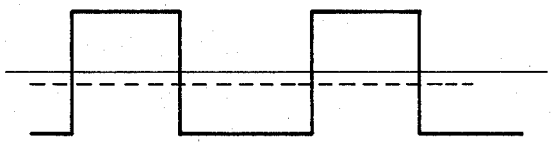
Figure 7C:
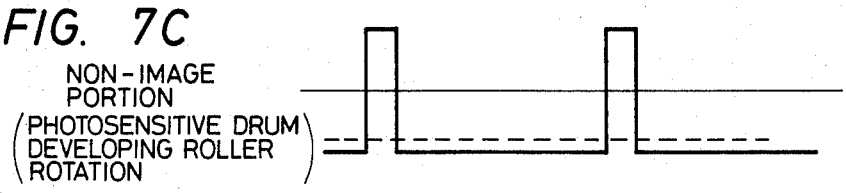

Curves (A) to (C) shown in FIG. 7 show an example of the control.

In the copier or laser beam printer, during a stand-by state, or in a non-imaging period in which the photosensitive drum and the developing roller are stopped, the duty ratio of the square wave is controlled to 1:1 as shown by the curve (A) in FIG. 7, whereby the average DC voltage of the developing bias is maintained at OV.

In an imaging period, or during image formation, the duty ratio is slightly shifted to the negative side as represented by the curve (B) in FIG. 7 to obtain an average DC voltage of ca. −100V. In this state the microcomputer 12 enables the regulation of the duty ratio by means of the variable resistor VR1, whereby the operator can regulate the duty ratio around the above-mentioned value to obtain a desired image density.

In a non-imaging period involving the rotation of the photosensitive drum and the developing roller, such as the inversion of the optical system or the original support table, the duty ratio of the developing bias voltage is so controlled that the average DC voltage thereof is equal to ca. −500V as represented by the curve (C) in FIG. 7, thereby preventing the deposition of toner onto the photosensitive drum.

Figure 8:
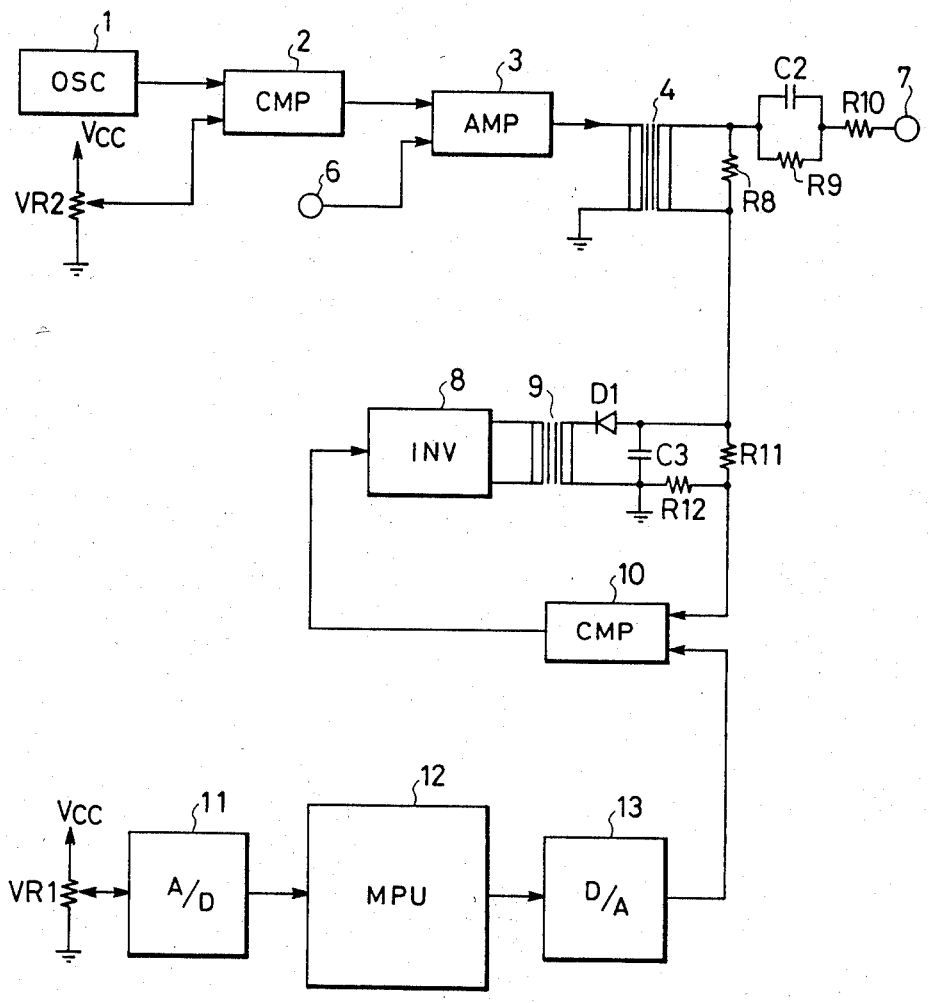
FIGS. 8, 9 and 10 are block diagrams showing still other embodiments of the present invention.

It is also possible to control the resolving power and tonal rendition by superposing a DC voltage to the square wave of variable duty ratio. FIG. 8 shows such an embodiment, wherein same or similar components as those in FIG. 6 are represented by same numbers and will not be explained in detail.

The embodiment shown in FIG. 8 is provided, in addition to the circuit shown in FIG. 6, with an additional structure for adding a high DC voltage to the secondary side of the voltage elevating transformer 4. In FIG. 8, the voltage divided by the image density regulating variable resistor VR1 is supplied, after conversion into a digital value by the A/D converter 11, to the microcomputer 12. In response to a corresponding digital value is released by the microcomputer 12 and supplied, after conversion into an analog value by the D/A converter 13, to an input terminal of the comparator 10, of which the other input terminal receives the output voltage of an inverter transformer 9. An inverter circuit 8 is so controlled that the output voltage of said inverter transformer 9 becomes equal to a voltage corresponding to the control by the variable resistor 11. To the secondary side of the inverter transformer 9 there is connected a rectifying and smoothing circuit composed of a diode D1 and a condenser C3 to generate a high DC voltage, which is supplied to the secondary side of the voltage elevating transformer 4 through said diode D1. The DC voltage thus superposed is fed back, after voltage division by resistors R11, R12, to the comparator 10, which controls a switching transistor or the like constituting the inverter circuit 8 in such a manner that said divided voltage becomes equal to the analog value supplied from the D/A converter 13. Also in this case the secondary side of the voltage elevating transformer 4 is provided, similar to the circuit shown in FIG. 4, with a breeder resistor R8 and a protecting circuit composed of resistors R9, R10 and a condenser C2.

The control of the image density and the prevention of toner deposition in the aforementioned non-imaging period can be attained, in addition to the aforementioned control of duty ratio, by the control of the DC voltage to be superposed to the developing bias voltage in response to the signal obtained from the variable resistor VR1.

Also in the present embodiment an image quality regulating variable resistor VR2 is used to control the duty ratio of the AC component of the developing bias through the comparator 2, thereby regulating the contrast, i.e. the relationship between the superposed DC voltage and the image density, thus arbitrarily controlling the resolving power and the tonal rendition.

Figure 9:
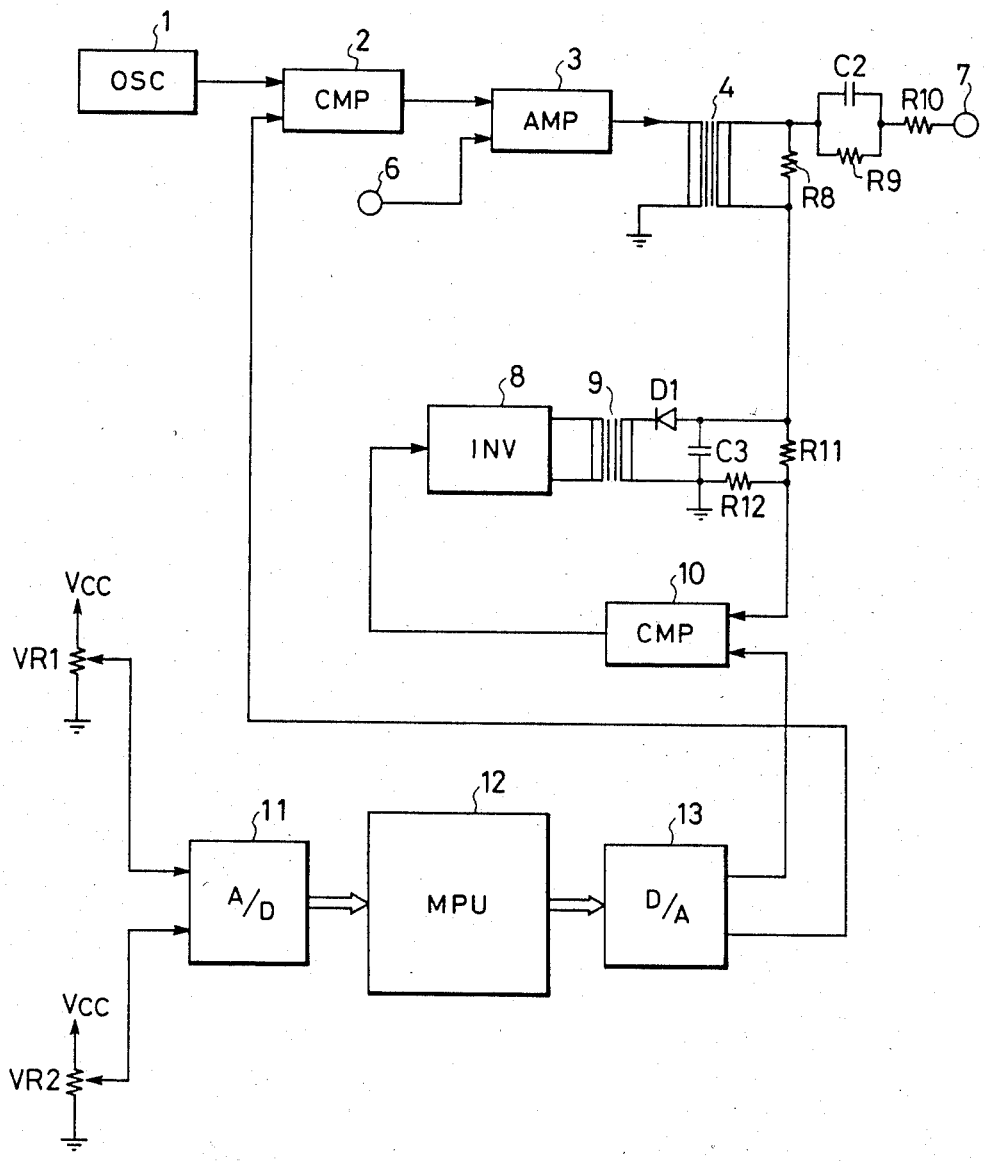

The controls of the duty ratio of the square wave and of the superposed DC voltage may be achieved by a microcomputer as shown in FIG. 9.

In FIG. 9, the above-mentioned variable resistors VR1, VR2 are both connected to the D/A converter 11 for converting the input signals of said variable resistors into digital values for supply to the microcomputer 12, which supplies digital control signals calculated according to the above-mentioned image forming conditions to the D/A converter 13 to obtain analog signals for supply to the comparators 2 and 10. In this manner the control of image density, prevention of toner deposition in the non-imaging period and image quality control are achieved through the microcomputer.

Furthermore, other control conditions such as the surface potential of the photosensitive drum may be taken into consideration into the control.

Figure 10:
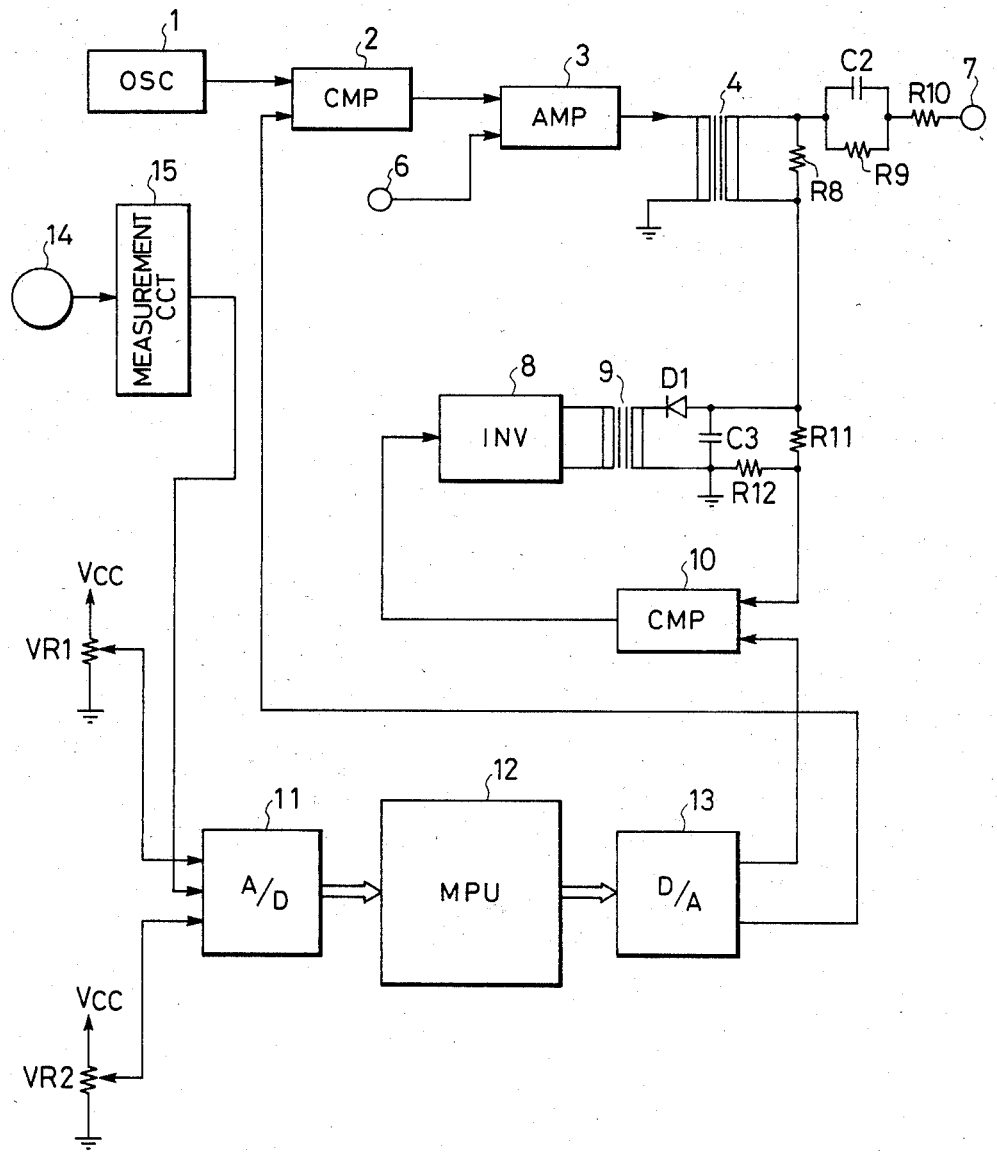

FIG. 10 shows another embodiment which also considers the surface potential of the photosensitive drum in the control of the duty ratio of developing bias and of the superposed DC voltage.

In FIG. 10, the potential of the latent image formed on the photosensitive drum is measured by the aforementioned surface potential sensor 14, then is processed by a measurement circuit 15 and supplied to the A/D converter 11. The output signal of said surface potential sensor is converted, in the measurement circuit 15, into a DC voltage equal to ca. 1/300 of the surface potential and supplied to the A/D converter 11, which converts said voltage into a digital signal for supply to the microcomputer 12 for correcting the values supplied from said image density regulating variable resistor VR1 and said image quality regulating variable resistor VR2. The microcomputer 12 performs, in response to the measured surface potential of the photosensitive drum 109, the control of the amount of light emission from an original illuminating lamp 102, control of chargers 111, 113, discrimination of the nature of the original image etc. In this manner the surface potential of the photosensitive drum can be taken into the control of the duty ratio of the developing bias and the level of the superposed Dc voltage.

As explained in the foregoing, a square wave of a variable duty ratio corresponding to the image forming conditions can be employed as the developing bias voltage. In this case, the smaller difference between the average level and the peak value in comparison with the conventional sinusoidal developing bias allows to stabilize the toner flight and to prevent discharge between the photosensitive drum and the developing sleeve. Also the duty ratio regulating process of the present invention can be employed in place of the conventional process of regulating the average level of the developing bias by superposing a DC voltage to the sinusoidal wave, thus achieving a similar control in easier manner without employing an excessively high peak value. It is therefore rendered possible to realize a smaller and simpler apparatus with a lower cost, for example by the elimination of a high DC voltage source. Furthermore there is obtained an additional advantage of a significantly smaller power loss in the amplifier in comparison with the case of conventional sinusoidal developing bias voltage.

Also in case of superposing a high DC voltage to the developing bias voltage as shown in FIGS. 8 and 9, the range of the superposed DC voltage can be made narrower than in the conventional process and the control of image quality such as resolving power and tonal rendition can be realized in an easier manner since the average level of the developing bias voltage can be regulated by the duty ratio of the square wave.

Furthermore, the embodiment shown in FIG. 9 is capable of more accurate control and has an advantage of automatically compensating the time-dependent fatigue of the photosensitive drum, since the surface potential of the photosensitive drum is taken into consideration in controlling the duty ratio of the square wave developing bias voltage and the level of the superposed DC voltage.

The present invention has been explained by certain embodiments thereof, but it further encompasses various modifications as explained in the following.

The duty ratio may be regulated according to the desired contrast characteristic of the image in addition to the aforementioned purpose for the image density control and the prevention of toner deposition in the non-imaging period. Also it is possible to identify the nature of the original image, for example a linetone image or a halftone image, through the microcomputer, by measuring the potential of the latent image, particularly the background thereof, formed on the photosensitive drum. Consequently it is also possible to control the density, contrast characteristic etc. according to the nature of the original image by controlling the duty ratio or the superposed DC voltage of the developing bias.

Also the generation of a square wave with a variable duty ratio is not limited to the foregoing process but can be achieved in various methods, for example a process in which a square wave is converted by an integrator into a sawtooth wave and the duty ratio is regulated by a comparator.

Furthermore, a filter may be inserted between the comparator and the amplifier in order to prevent an overshoot phenomenon at the amplifier or at the voltage-elevating transformer. Said filter may also be inserted between the amplifier and the voltage elevating transformer for reducing the power loss.

Also a switching circuit may be employed, in place the amplifier, for driving the voltage elevating transformer, thus reducing the power loss.

The A/D and D/A converters shown in FIG. 6 may be composed by hardware or by a software or a part thereof of the microcomputer.

I claim:

1. An image forming apparatus comprising:

image forming means for forming an image on a recording member;

wherein said image forming means comprises latent image forming means for forming an electrostatic latent image on said recording member and developing means for recording said electrostatic latent image visible;

bias voltage generating means for supplying said developing means with a bias voltage having a square wave form; and setting means for setting, in variable manner, duty ratio of said square wave.

2. An image forming apparatus according to claim 1, wherein said bias voltage generating means comprises signal generating means for generating a sawtooth wave, and comparator means for comparing the sawtooth wave generated by said signal generating means with a determined reference voltage.

3. An image forming apparatus according to claim 2, wherein said setting means is adapted to set said reference voltage.

4. An image forming apparatus according to claim 3, wherein said setting means comprises regulating means for manually regulating said reference voltage to render said duty ratio variable.

5. An image forming apparatus according to claim 3, wherein said setting means comprises control means for regulating said reference voltage according to image forming conditions of said image forming means thereby rendering said duty ratio variable.

6. An image forming apparatus according to claim 1, wherein said setting means is adapted to select different duty ratios respectively in an image forming period and an image non-forming period of said image forming means.

7. An image forming apparatus according to claim 1, wherein said setting means is adapted to select different duty ratios respectively in the image area and the non-image area of said recording member.

8. An image forming apparatus according to claim 5, wherein said control means comprises detecting means for detecting the surface state of said recording member and is adapted to regulate said reference voltage according to the output of said detecting means.

9. An image forming apparatus according to claim 8, wherein said detecting means comprises a surface potential meter.

10. An image forming apparatus comprising:

image forming means for forming an image on a recording member;

wherein said image forming means comprises latent image forming means for forming an electrostatic latent image on said recording member and developing means for rendering said electrostatic latent image visible; and bias voltage generating means for supplying said developing means with a bias voltage;

wherein said bias voltage generating means comprises first voltage generating means for generating a square wave voltage of a determined duty ratio and second voltage generating means for generating a determined DC voltage, wherein said bias voltage is obtained by superposing said DC voltage on said square wave voltage.

11. An image forming apparatus according to claim 10, wherein said first voltage generating means comprises first setting means for setting said duty ratio by means of which said duty ratio is rendered variable.

12. An image forming apparatus according to claim 11, wherein said first voltage generating means comprises signal generating means for generating a sawtooth wave and comparator means for comparing the sawtooth wave voltage generated by said signal generating means with a determined reference voltage.

13. An image forming apparatus according to claim 12, wherein said first setting means is adapted to set said reference voltage.

14. An image forming apparatus according to claim 13, wherein said first setting means comprises regulating means for manually regulating said reference voltage to render said duty ratio variable.

15. An image forming apparatus according to claim 13, wherein said first setting means comprises control means for regulating said reference voltage according to image forming conditions of said image forming means thereby rendering said duty ratio variable.

16. An image forming apparatus according to claim 10, wherein said second voltage generating means comprises second setting means for setting the value of said DC voltage, by means of which said value of said DC voltage is rendered variable.

17. An image forming apparatus according to claim 16, wherein said second setting means comprises regulating means for manually regulating the value of said DC voltage.

18. An image forming apparatus according to claim 16, wherein said second setting means comprises control means for regulating the value of said DC voltage according to image forming conditions of said image forming means.

19. An image forming apparatus according to claim 18, wherein said control means comprises detecting means for detecting the surface state of said recording member and is adapted to regulate the value of said DC voltage according to the output of said detecting means.

20. An image forming apparatus according to claim 19, wherein said detecting means comprises a surface potential meter.

21. An image forming apparatus comprising:

image forming means for forming an image on a recording member;

wherein said image forming means comprises latent image forming means for forming an electrostatic latent image on said recording member and developing means for rendering said electrostatic latent image visible;

bias voltage generating means for supplying said developing means with a bias voltage composed of a square wave voltage and a DC voltage superposed thereto; and control means for regulating the duty ratio or the value of said DC voltage according to image forming conditions of said image forming means.

22. An image forming apparatus according to claim 21, wherein said control means comprises detecting means for detecting the surface state of said recording member and is adapted to regulate the value of said DC voltage according to the output of said detecting means.

23. An image forming apparatus according to claim 22, wherein said detecting means comprises a surface potential meter.

* * * * *

UNITED STATES PATENT AND TRADEMARK OFFICE

CERTIFICATE OF CORRECTION

PATENT NO. : 4,600,295

DATED : July 15, 1986

INVENTOR(S) : KOJI SUZUKI

It is certified that error appears in the above-identified patent and that said Letters Patent is hereby corrected as shown below:

COLUMN 7

Line 34, "manner, duty" to --manner, the duty--.

Signed and Sealed this

Nineteenth Day of July, 1988

*Attest:*

*Attesting Officer*

DONALD J. QUIGG

*Commissioner of Patents and Trademarks*